US008764342B1

(12) United States Patent
Kopacz et al.

(10) Patent No.: US 8,764,342 B1
(45) Date of Patent: Jul. 1, 2014

(54) SYSTEM AND METHOD FOR MOUNTING WEAR BAR TO SCREED ASSEMBLY

(71) Applicant: Caterpillar Paving Products Inc., Brooklyn Park, MN (US)

(72) Inventors: Jason William Kopacz, St. Louis Park, MN (US); Tobin Dale Rasmusson, Bloomington, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/767,373

(22) Filed: Feb. 14, 2013

(51) Int. Cl.
*E01C 19/22* (2006.01)
*E01C 19/43* (2006.01)
*E02F 3/76* (2006.01)

(52) U.S. Cl.
CPC ..... *E01C 19/43* (2013.01); *E02F 3/7695* (2013.01)
USPC ..... 404/118; 404/83; 37/381

(58) Field of Classification Search
CPC ..... E02F 3/7695; E01C 19/43
USPC ..... 404/83, 118; 37/381
See application file for complete search history.

(56) References Cited

U.S. PATENT DOCUMENTS

| | | | | |
|---|---|---|---|---|
| 1,388,690 | A | 8/1921 | Baker | |
| 2,473,961 | A | 9/1944 | Mandt et al. | |
| 2,840,934 | A * | 7/1958 | Hazzard et al. | 172/777 |
| 3,262,378 | A | 10/1963 | Schrimper et al. | |
| 3,456,370 | A * | 7/1969 | Gilbertson | 172/701.2 |
| 3,736,664 | A * | 6/1973 | Black et al. | 37/446 |
| 4,269,275 | A * | 5/1981 | Cousin | 172/719 |
| 4,290,214 | A * | 9/1981 | Stepe | 37/448 |
| 4,570,366 | A * | 2/1986 | Yost | 37/232 |
| 5,941,659 | A * | 8/1999 | Godbersen | 404/88 |
| 6,106,192 | A * | 8/2000 | Hargis et al. | 404/101 |
| 7,266,914 | B2 * | 9/2007 | Grant | 37/446 |
| 8,128,314 | B2 | 3/2012 | Buschmann et al. | |
| 8,141,837 | B2 | 3/2012 | Charters | |
| 2001/0034946 | A1 | 11/2001 | Hamdorf | |
| 2002/0061227 | A1 | 5/2002 | Rahn et al. | |
| 2005/0126056 | A1 * | 6/2005 | Kostecki | 37/379 |

FOREIGN PATENT DOCUMENTS

| | | |
|---|---|---|
| GB | 823701 | 9/1959 |

* cited by examiner

*Primary Examiner* — Raymond W Addie
(74) *Attorney, Agent, or Firm* — Miller, Matthias & Hull

(57) ABSTRACT

A system and method for mounting a wear bar to a screed frame in a screed assembly may include providing a first set of frame alignment holes on the screed frame, the first set of frame alignment holes having a substantially horizontal orientation. The system and method may also include providing a first set of wear bar alignment holes on the wear bar, the first set of wear bar alignment holes having a substantially sloping orientation and aligning at least one of the first set of frame alignment holes with at least one of the first set of wear bar alignment holes to achieve a desired height tolerance of the wear bar relative to a screed plate.

20 Claims, 6 Drawing Sheets

SYSTEM AND METHOD FOR MOUNTING WEAR BAR TO SCREED ASSEMBLY

TECHNICAL FIELD

The present disclosure relates to a paving machine and, more particularly, relates to a system and method for mounting a wear bar to a screed frame of a screed assembly in a paving machine.

BACKGROUND

Paving machines are generally used for laying heated paving material, such as, bituminous aggregate mixtures or asphalt, onto a roadbed or a paving surface. After heated asphalt is laid, it is typically spread, leveled, compacted and cooled to achieve a road with a uniform and smooth surface passable by vehicles. To compact and spread the heated asphalt, the paving machine typically employs a screed assembly. The screed assembly can be self-propelled or be pulled by tractors, trucks or other similar equipment. The screed assembly may include one or more screed sections that may receive a supply of asphalt from the truck or tractor and may heat, vibrate and/or manipulate the asphalt into a smooth uniform surface.

Often, the screed assembly includes two main screed sections in the center of the screed assembly, and hydraulically extendable screed extenders connected to the sides of the main screed sections for greater paving widths. In addition to the main screed sections and the screed extenders, bolt-on extensions may be connected to the screed extenders for paving even larger areas. For example, for paving an area greater than five meters, six or more screed sections including, two main screed sections, two screed extenders and two or more bolt-on extensions may be employed.

To improve the asphalt compacting and spreading capability of the various screed sections, screed assemblies often utilize a tamping mechanism. The tamping mechanism may pre-compact the asphalt before delivering the asphalt to a screed plate. The tamping mechanism may include a tamper bar and a wear bar on each screed section. The tamper bar may pre-compact and feed the asphalt under the screed plate for effective spreading and further compacting on the paving surface. The wear bar, on the other hand, may be found behind the tamper bar and may be mounted to a screed frame such that a bottom surface of the wear bar is substantially aligned with a bottom surface of the screed plate. The wear bar minimizes wear and tear to the screed plate and the screed frame to which the wear bar is mounted to.

The wear bar, which is a replaceable component, is generally mounted to the screed frame such that a bottom edge of the wear bar is above the bottom edge of the screed plate. In other words, the wear bar maintains a height tolerance relative to the bottom (asphalt finishing surface) plane of the screed plate. Such a height tolerance is often desired to prevent the wear bar from protruding or otherwise extending beyond the bottom edge of the screed plate (and therefore the screed section) and, thus, leaving a pattern or deft mark on the paving surface as the associated screed section compacts and spreads the asphalt.

Specifically, if the wear bar protrudes below the screed plate, asphalt may potentially stick to the wear bar causing an irregularity (i.e. drag marks, gouges, and segregation of material) in the finished asphalt surface. Such irregularity may also be present in the final asphalt surface if the wear bar is above the screed plate by more than one millimeter. For example, a rock may get stuck or catch the edge of the screed plate leading to variations in the surface texture of the road. Thus, the height tolerance of the wear bar relative to the screed plate is maintained anywhere from a zero millimeters (0 mm) or flush to a one millimeter (1 mm) above the bottom edge of the screed plate.

Since the wear bar is a replaceable component, the height tolerance is required to be maintained every time the old wear bar or old screed plate is replaced and a new wear bar or new screed plate is mounted to the screed frame. Maintaining this height tolerance is challenging, particularly because of the tolerance stack-up between the screed plate and the screed frame or due to assembling a worn wear bar with a new screed plate (or a new wear bar with a worn screed plate). One prior art solution to maintain the height tolerance involves mounting the wear bar to the frame and then grinding any part of the wear bar that protrudes below the screed plate. For a standard sized wear bar being mounted to a thicker screed plate, lesser grinding may be needed (because a smaller portion of the wear bar may extend beyond the screed plate), while additional grinding may be needed for thinner screed plate. Such grinding not only takes time, it increases labor costs and at least somewhat compromises the structural integrity of the wear bar.

Another prior art solution involves lining up the wear bar in the correct location against the screed frame and drilling holes through both the wear bar and the screed frame and connecting with fasteners. This technique is typically not employed because of the time and costs involved in drilling holes on the assembly line. Furthermore, drilling is not a favorable process to perform on the assembly line.

Yet another prior art solution for varying heights is discussed in U.S. Pat. No. 3,262,378 issued to Schrimper et al. for adjusting the height of a strike-off plate extending downwardly from a mold board of a screed. The patent employs an adjusting means having at least two adjusting members fixed to the strike-off plate at spaced locations thereof. The adjusting means varies the height of the strike-off plate by one half an inch from a central position by way of a shoulder bolt threaded into a front wall of a screed section. The shoulder portion of the bolt passes through a vertical slot such that by varying the position of the shoulder bolt within the vertical slot, the height of the strike-off plate may be varied. Such a height varying mechanism may not work effectively for a wear plate, especially since the height of the wear bar is not constantly changed unlike a strike-off plate. Furthermore, a shoulder bolt varying in position within a vertical slot may not be sufficient to maintain the desired height tolerance for an extended period of time.

It would accordingly be beneficial if an improved mechanism for effectively mounting the wear bar to the screed frame while maintaining the desired height tolerance with the screed plate can be achieved. It will additionally be beneficial if the mechanism maintained the height tolerance irrespective of the varying thicknesses of the screed plate.

SUMMARY

In accordance with one aspect of the present disclosure, a method for mounting a wear bar to a screed frame of a screed section is disclosed. The method may include providing a first set of frame alignment holes on the screed frame, the first set of frame alignment holes having a substantially horizontal orientation and providing a first set of wear bar alignment holes on the wear bar, the first set of wear bar alignment holes having a substantially sloping orientation. The method may also include aligning at least one of the first set of frame alignment holes with at least one of the first set of wear bar alignment holes to achieve a desired height tolerance of the wear bar relative to a screed plate.

In accordance with another aspect of the present disclosure, a screed assembly is disclosed. The screed assembly may include a screed section having a screed frame, the screed frame having a plurality of frame alignment holes along a length thereof. The screed assembly may also include a wear bar mounted at least indirectly to the screed frame, the wear bar having a plurality of wear bar alignment holes along a length thereof and the plurality of wear bar alignment holes substantially corresponding in placement to the plurality of frame alignment holes. The plurality of wear bar alignment holes and the plurality of frame alignment holes may be capable of mounting the wear bar to the screed frame via a fastener In accordance with yet another aspect of the present disclosure, a paving machine is disclosed. The paving machine may include an engine and a screed assembly operatively associated with the engine. The screed assembly may include a plurality of screed sections, each of the screed sections having a screed frame with a first set of frame alignment holes in a substantially horizontal orientation. The screed assembly may also include a wear bar mounted at least indirectly to the screed frame of each of the plurality of screed sections and having a first set of wear bar alignment holes in a substantially sloping orientation, one of the first set of wear bar alignment holes capable of aligning with one of the first set of frame alignment holes.

These and other aspects and features of the present disclosure will be more readily understood upon reading the following description when taken in conjunction with the accompanying drawings.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents falling within the spirit and scope of the present disclosure.

DETAILED DESCRIPTION

Among other things, the present disclosure provides a system and method for assembling a wear bar to a screed frame while achieving a desired height tolerance of a bottom surface of the wear bar relative to a bottom surface of a screed plate. The height tolerance may be achieved in a manner that avoids the grinding or drilling techniques used in the prior art discussed above.

Figure 1:
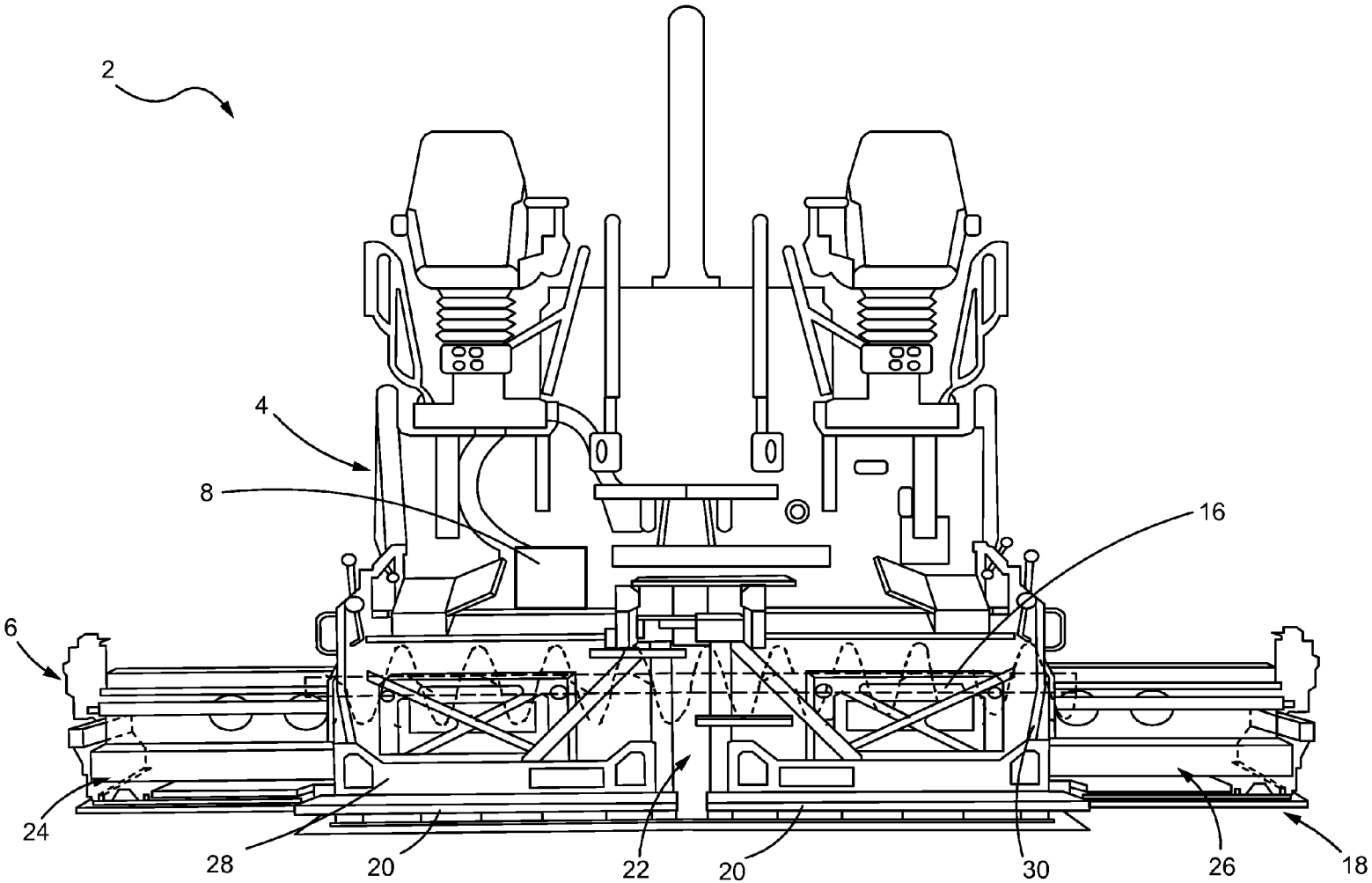
FIG. 1 is a rear perspective view of a paving machine constructed in accordance with at least some teachings of the present disclosure.

Referring now to FIG. 1, an exemplary paving machine 2 is schematically shown, in accordance with at least some embodiments of the present disclosure. It will be understood that only those components that are essential for a proper understanding of the present disclosure have been shown and/or described herein. Nevertheless, several other components that are commonly employed in combination or conjunction with such paving machines are contemplated and considered within the scope of the present disclosure.

Thus, as shown, the paving machine 2 may include a tractor 4 towing a screed assembly 6. The tractor 4 may include an engine 8, a hopper 14 for receiving and temporarily storing a supply of asphalt, as well as feeder conveyors or augers 16 for moving the asphalt from the hopper to the screed assembly 6. Once the asphalt reaches the screed assembly 6, the screed assembly may compact, level and shape the asphalt into a layer of desired thickness, size and uniformity. To do so, the screed assembly 6 may employ a number of screed sections 18. Although not shown and described herein, the screed assembly 6 may also employ various leveling arms, mold boards, burners, heating elements and vibrators in addition to the screed sections, for heating, paving, compacting, leveling, shaping and/or smoothing the asphalt. The screed assembly 6 may also include a plurality of walkways 20 to facilitate movement of workers thereon when the screed assembly is in use.

With respect to the screed sections 18, in at least some embodiments, they may include a main screed section 22, a left extender 24 and a right extender 26. The main screed section 22 may further be divided into a left main screed section 28 and a right main screed section 30. Although not shown, in at least some embodiments, the screed sections 18 may also include one or more left and right bolt-on extensions (BOE) connected to the respective left extender 24 and the right extender 26 for further increasing the paving width of the asphalt. The left extender 24 and the left BOE extension, when present, may be connected to the left of the left main screed section 28 and the right extender 26 and the right BOE extension, when present, may be connected to the right of the right main screed section 30. In at least some embodiments, each of the screed sections 18 may be hydraulically controlled and may be mounted in a manner commonly employed. Notwithstanding the fact that in the present embodiment, two of the main screed sections and two of the screed extender elements have been shown, in at least some embodiments, the number of these sections (and the number of BOE extensions) may vary depending particularly upon the width of the paving area that is desired.

Figure 2:
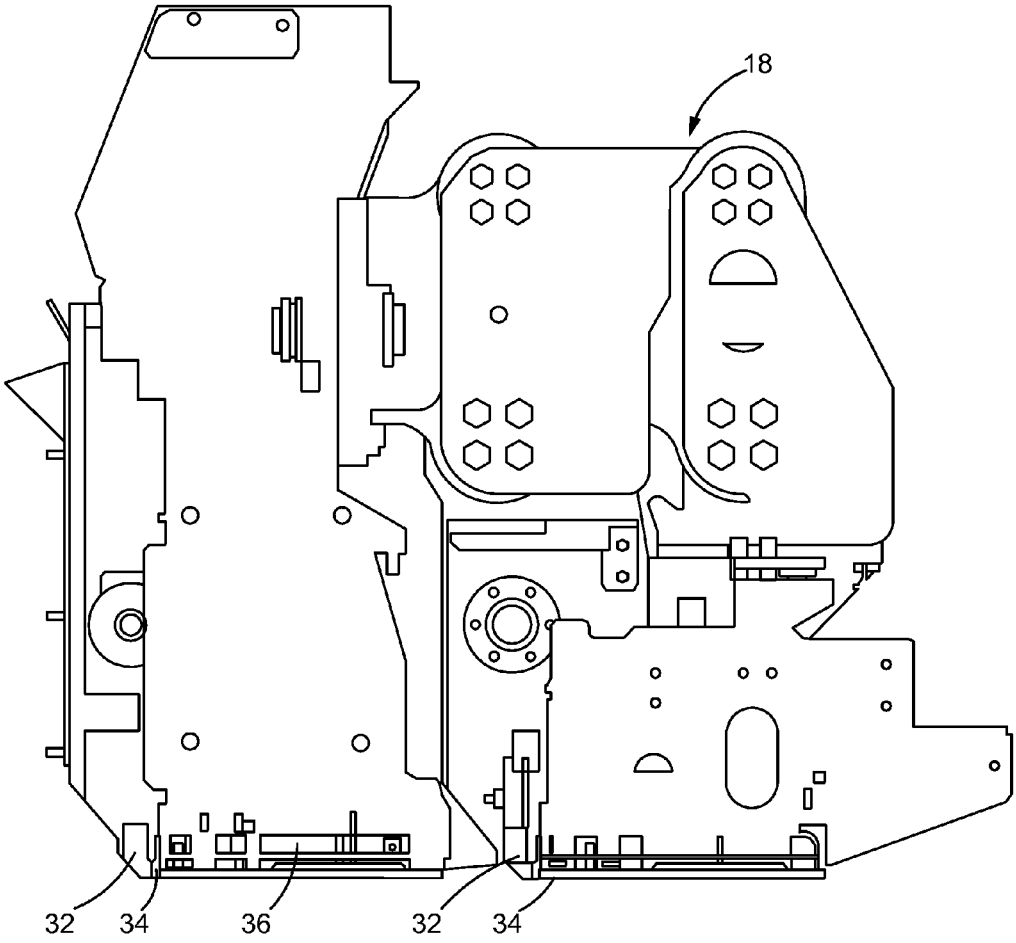
FIG. 2 is a side view, in cut-away, of a screed assembly employed by the paving machine of FIG. 1.
Figure 3:
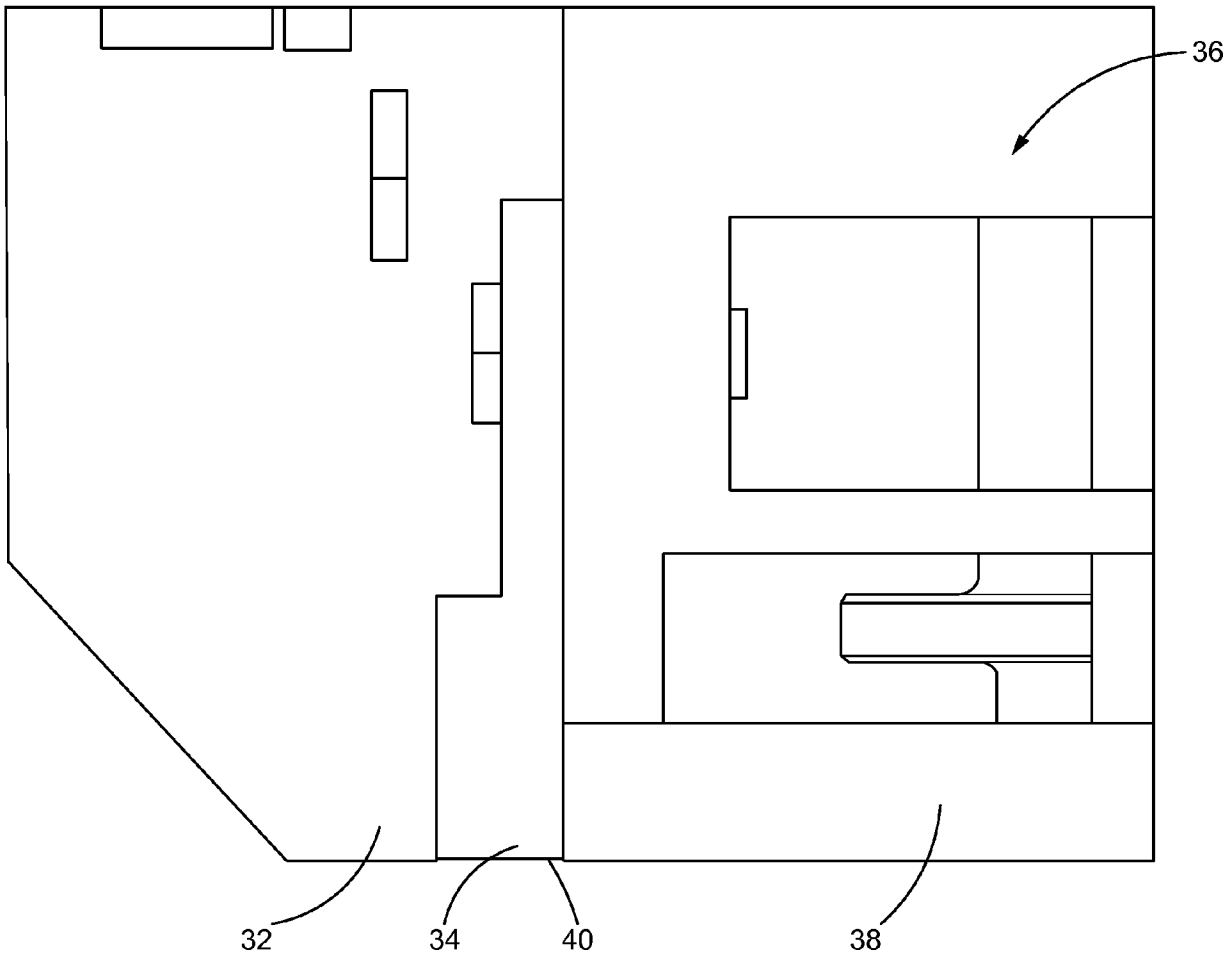
FIG. 3 is a portion, in cut-away, of the screed assembly of FIG. 2 showing a height tolerance of a wear bar in relation to a tamper bar and a screed plate, in accordance with at least some embodiments of the present disclosure.

Turning now to FIG. 2 and referring to it in conjunction with FIG. 1, a side-view, in cut-away, of the screed assembly 6 is shown, in accordance with at least some embodiments of the present disclosure. As shown in FIG. 2, each of screed sections 18 may also include a tamper bar 32. The tamper bar 32 may facilitate pre-compaction of the asphalt received from the hopper and may push the asphalt beneath the screed section 18 for further compaction. In addition to the tamper bar 32, each of the screed sections 18 may also include a wear bar 34. The wear bar 34 may typically be mounted (e.g., attached/connected) behind the tamper bar 32 and in between the tamper bar, a screed frame 36 and a screed plate 38. The wear bar 34 may be employed for protecting the screed sections 18 from unnecessary wear and tear. Furthermore, the wear bar 34 may be mounted slightly above a bottom edge of the screed plate 38, as described above and also shown in FIG. 3, to achieve a height tolerance. For example, in at least some embodiments, the wear bar 34 may be mounted such that a bottom edge 40 of the wear bar is anywhere from zero millimeters (0 mm) or in other words, flush, to a one millimeter (1 mm) above the bottom edge of the screed plate 38.

Achieving the height tolerance by mounting the wear bar 34 slightly above the screed plate 38 may ensure that the wear bar does not extend beyond the screed plate and, thus, does not leave a pattern or deft mark on the paving surface. In order to maintain the height tolerance, the screed frame 36 and the wear bar 34 may each be provided with a plurality of alignment holes, as discussed below in FIGS. 4-6. One of the alignment holes on the screed frame 36 may be aligned with one of the alignment holes on the wear bar 34 such that the flush-one millimeter height tolerance of the wear bar relative to the screed plate 38 may be achieved. The alignment holes are particularly beneficial since they facilitate maintaining the height tolerance irrespective of the thickness of the screed plate 38 and the varying length of the wear bar 34 due to heating during the replacement process of the wear bar.

Figure 4:
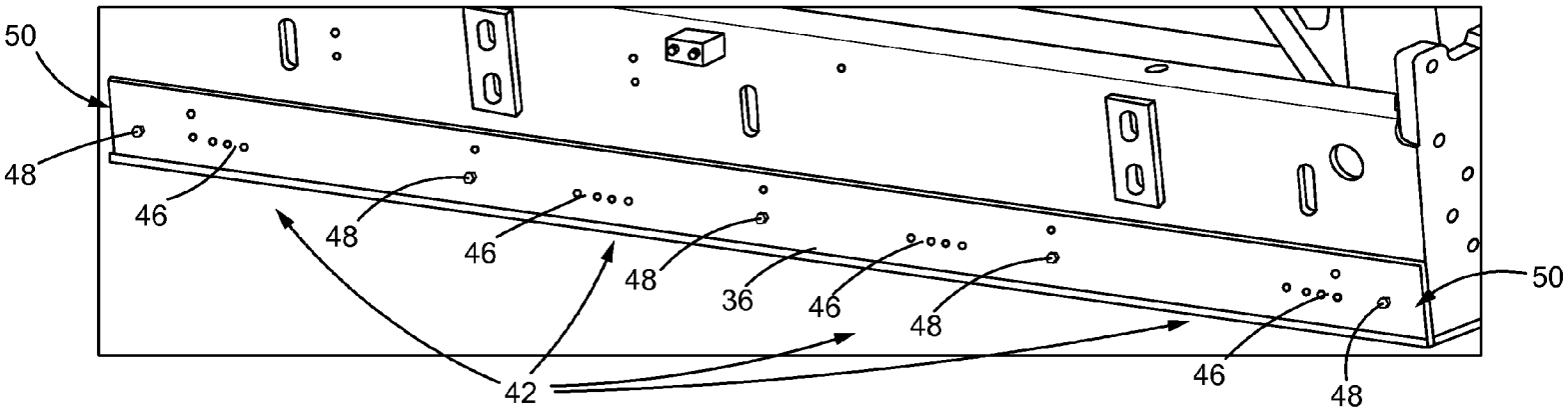
FIG. 4 is a schematic illustration showing a plurality of frame alignment holes in the screed frame of FIG. 3, in accordance with at least some embodiments of the present disclosure.
Figure 5:
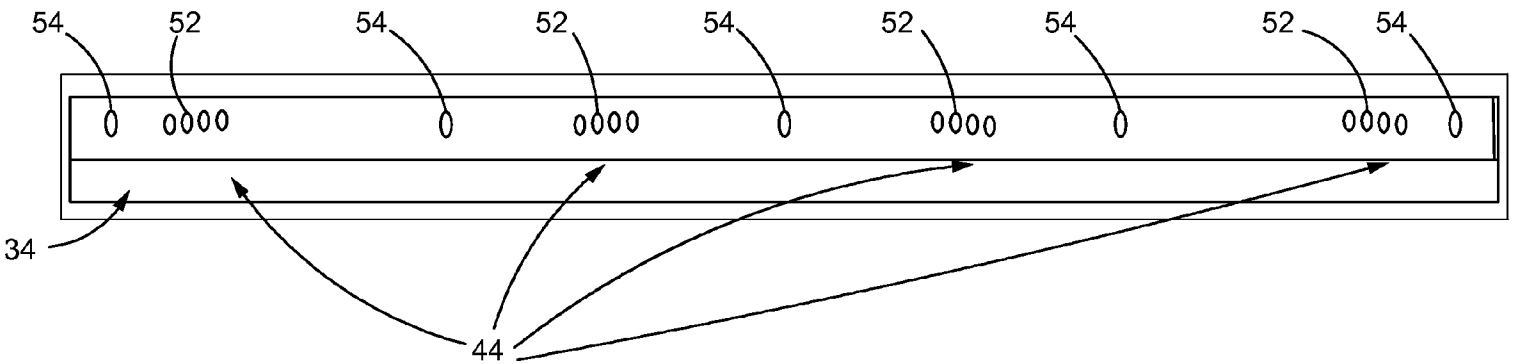
FIG. 5 is a schematic illustration showing a plurality of wear bar alignment holes in the wear bar of FIG. 3, in accordance with at least some embodiments of the present disclosure.
Figure 6:
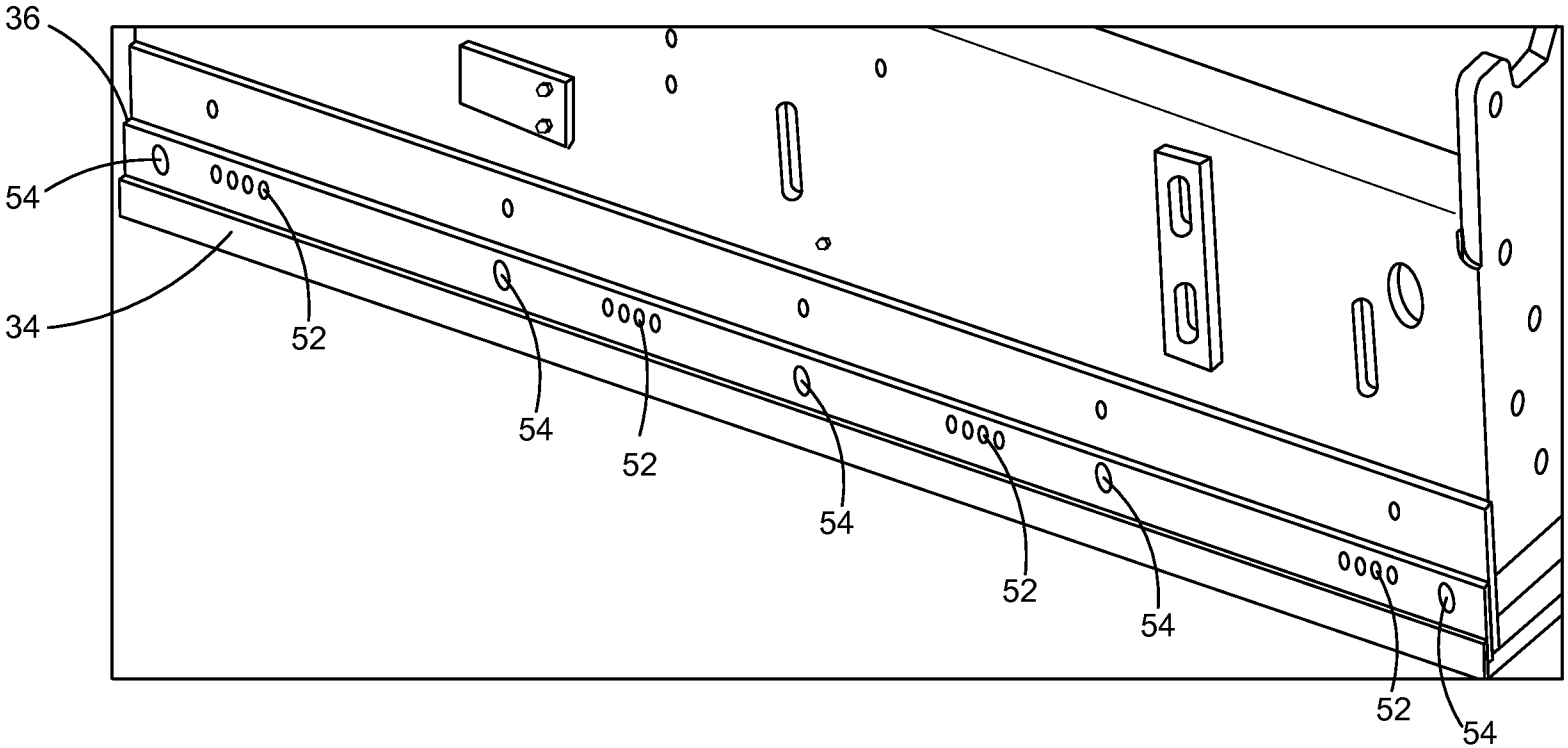
FIG. 6 is a schematic illustration showing the wear bar of FIG. 5 mounted to the screed frame of FIG. 4.

Referring now to FIGS. 4-6, the alignment holes in the screed frame 36, the alignment holes in the wear bar 34 and the relationship between those two sets of holes will be described. Specifically, FIG. 4 shows the screed frame 36 without the wear bar 34 mounted thereto and having a plurality of frame alignment holes 42. Similarly, FIG. 5 shows the wear bar 34 without the screed frame 36 and having a plurality of wear bar alignment holes 44. FIG. 6, on the other hand, shows the wear bar 34 mounted to the screed frame 36 and shows the relationship between the frame alignment holes 42 and the wear bar alignment holes 44.

Turning specifically to FIG. 4, the frame alignment holes 42 on the screed frame 36 may include a first set of frame alignment holes 46 and a second set of frame alignment holes 48. The first set of frame alignment holes 46 may include a plurality of hole clusters spaced apart along the length of the screed frame 36, while the second set of frame alignment holes 48 may include individual holes interspersed in between the first set of alignment holes. For example and as shown in FIG. 4, the first set of frame alignment holes 46 may include four hole clusters with each hole cluster having four holes. The four hole clusters may be evenly spaced out along the length of the screed frame 36 with one pair of hole clusters being in the proximity of outer ends 50 of the screed frame, while two hole clusters being around the center of the screed frame. For example, in at least some embodiments, each hole cluster may be about eighteen millimeters (18 mm) apart from its neighboring hole cluster. In other embodiments, the spacing between the hole clusters may vary. Within each hole cluster, the holes may be evenly spaced out as well. With respect to the second set of frame alignment holes 48, one of those holes may be provided in between every two hole clusters of the first set of frame alignment holes 46, with one of the second set of frame alignment holes being provided at the outer ends 50 of the screed frame 36, as shown in FIG. 4.

One hole in each hole cluster of the first set of frame alignment holes 46 and each of the second set of frame alignment holes 48 may be employed to align with corresponding holes on the wear bar 34, as described below. Furthermore, each of the first and the second set of frame alignment holes 46 and 48, respectively, may be machined directly into the body of the screed frame 36 in a manner commonly employed. Additionally, the first and the second set of frame alignment holes 46 and 48, respectively, may be substantially horizontally oriented along a single straight horizontal line running through the longitudinal length of the screed frame 36. As defined herein, the term "horizontal" mean along a plane parallel or substantially parallel to the bottom edge of the screed plate 38.

It will be understood that while in the present embodiment, the first set of frame alignment holes 46 has been described as having four hole clusters of four holes each, this is merely exemplary. In at least some other embodiments, the number of hole clusters and the number of holes within each hole cluster may vary depending upon the length of the screed frame 36 and the thickness tolerance of the screed plate 38. For example, longer screed frames may have more than four hole clusters, while shorter screed frames may have fewer than four hole clusters. Relatedly, looser toleranced screed plates 38 may have greater than four holes in each hole cluster, while tighter tolerance screed plates may have fewer than four holes in each hole cluster. As the number of hole clusters within the first set of frame alignment holes 46 vary, the number of holes within the second set of frame alignment holes 48 may vary as well, to ensure that each hole cluster in the first set of frame alignment holes is flanked on both sides by one of the second set of frame alignment holes.

Turning now to FIG. 5, the wear bar alignment holes 44 may include a first set of wear bar alignment holes 52 and a second set of wear bar alignment holes 54. The first set of wear bar alignment holes 52 may substantially correspond in placement to the first set of frame alignment holes 46, while the second set of wear bar alignment holes 54 may substantially correspond in placement with the second set of frame alignment holes 48 when the wear bar 34 is mounted to the screed frame 36. Similar to the first set of frame alignment holes 46, the first set of wear bar alignment holes 52 may include a plurality of hole clusters. For example and as shown in FIG. 5, the first set of wear bar alignment holes 52 may include four hole clusters with each hole cluster having four holes. Typically, the number of hole clusters in the first set of frame alignment holes 46 matches the number of hole clusters in the first set of wear bar alignment holes 52. However, in contrast to the first set of frame alignment holes 46, which may all be substantially horizontal in orientation, the first set of wear bar alignment holes 52 may have a sloping or substantially sloping or graded orientation. For example, in at least some embodiments, the holes within the first set of wear alignment holes 52 may be vertically spaced around eight tenths of a millimeter apart from a neighboring hole in a substantially sloping orientation.

By having a sloping or substantially sloping orientation of the first set of wear bar alignment holes 52, the wear bar 34 may be mounted to the screed frame 36 to achieve the desired height tolerance of the wear bar relative to the screed plate 38, as described further below. It will be understood that while each hole cluster within the first set of wear bar alignment holes 52 has been shown to include four holes, in at least some other embodiments, the number of holes within the hole clusters may vary (although all the hole clusters may typically have the same number of holes) depending particularly upon the thickness tolerance of the associated screed plate 38. Furthermore, the direction and the angle of the incline of the hole clusters may vary as well, also depending upon the thickness of the associated screed plate 38. Typically, a higher one of the sloping holes in each hole cluster of the first set of wear bar alignment holes 52 may be employed for aligning with one of the horizontal holes in each hole cluster of the first set of frame alignment holes 46 for a thicker screed plate 38, while a lower one of the sloping holes in each hole cluster of the first set of wear bar alignment holes may be employed for aligning with one of the horizontal holes in each hole cluster of the first set of frame alignment holes for a thinner screed plate.

With respect to the second set of wear bar alignment holes 54, similar to the second set of frame alignment holes 48, the second set of wear bar alignment holes may be individual holes that may flank the first set of wear bar alignment holes 52 on both sides. As discussed above, the second set of wear bar alignment holes 54 may be designed to align with the second set of frame alignment holes 48 when the wear bar 34 is mounted to the screed frame 36. Also similar to the second set of frame alignment holes 48, the second set of wear bar alignment holes 54 may be substantially horizontally oriented along the length of the wear bar 34. Both, the first and the second set of wear bar alignment holes 52 and 54, respectively, may be machined within the wear bar 34 or suitable mechanisms may be employed for forming the holes on the wear bar.

Turning now to FIG. 6, the wear bar 34 is shown mounted to the screed frame 36. As can be seen, upon mounting the wear bar 34 to the screed frame 36, the second set of frame alignment holes 48 align with the second set of wear bar alignment holes 54, while one of the holes within each hole cluster of the first set of frame alignment holes 46 aligns with one of the holes in each corresponding hole cluster of the first set of wear bar alignment holes 52. The method of mounting the wear bar 34 to the screed frame 36 is explained in greater detail below with respect to FIG. 7.

INDUSTRIAL APPLICABILITY

In general, the present disclosure sets forth a system and method for mounting a wear bar to a screed frame of a screed assembly. It is typically desirable to have a height tolerance of about zero millimeters to about one millimeter between a bottom edge of the wear bar and a bottom edge/plane of the screed plate after the wear bar is mounted to the screed frame. To achieve such a height tolerance without having to grind/drill the wear bar as in prior art methods, the present disclosure provides a series of frame alignment holes on the screed frame and a series of wear bar alignment holes on the wear bar that are designed to align with the frame alignment holes upon mounting, as discussed below.

Figure 7:
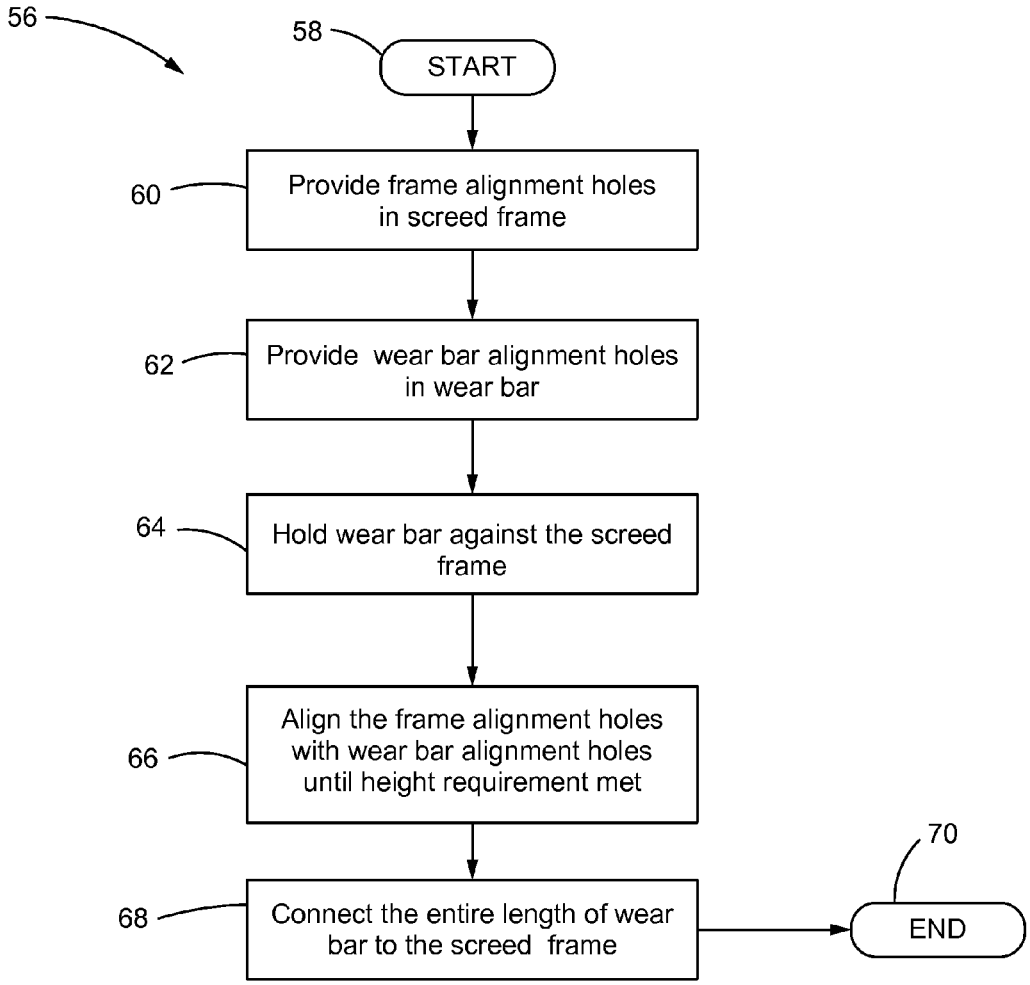
FIG. 7 is a flowchart showing exemplary steps of mounting the wear bar to the screed frame of FIG. 3.

Referring now to FIG. 7, a flowchart 56 showing a method of mounting the wear 34 to the screed frame 36 is described, in accordance with at least some embodiments of the present disclosure. As shown, after starting at a step 58 and before beginning the mounting process of the wear bar 34, the screed frame 36 may be provided with a series of frame alignment holes 42 including a first set of frame alignment holes 46 and a second set of frame alignment holes 48 at a step 60. As discussed above, each of the first set of frame alignment holes 46 and the second set of frame alignment holes 48 may be substantially horizontally oriented along the length of the screed frame 36 with one of the second set of frame alignment holes flanking the first set of frame alignment holes on either side thereof. Next, at a step 62, the wear bar 34 may be provided with a corresponding set of wear bar alignment holes 44, which may include a first set of wear bar alignment holes 52 that align with one of the first set of frame alignment holes 46 and the second set of wear bar alignment holes 54 that align with one of the second set of frame alignment holes 48. The first set of wear bar alignment holes 52 may have a substantially sloping profile to accommodate various thickness of the screed plate 38, while the second set of wear bar alignment holes 54 may be substantially horizontally oriented along the length of the wear bar 34, with one of those holes flanking each hole cluster of the first set of wear bar alignment holes 52 on either side thereof.

After machining the holes within the screed frame 36 and the wear bar 34 at the steps 60 and 62, respectively, the wear bar may be mounted to the screed frame by first temporarily holding the wear bar against the screed frame 36 at a step 64. The wear bar 34 may be held against the screed frame 36 by aligning and connecting at least one of the second set of frame alignment holes 48 on the screed frame with one of the second set of wear bar alignment holes 54 on the wear bar.

For example, in at least some embodiments, the two outer most (e.g., those closest to the outer ends 50) ones of the second set of frame alignment holes 48 and the second set of wear bar alignment holes 54 may be aligned and connected together. In some other embodiments, the inner most pair of the second set of frame alignment holes 48 and the second set of wear bar alignment holes 54 may be aligned and connected together. In yet other embodiments, a combination of one outer and one inner of the second set of frame alignment holes 48 and the second set of wear bar alignment holes 54 may be aligned and connected together. In further embodiments, only one of the second set of frame alignment holes 48 and the second set of wear bar alignment holes 54 may be connected together, if they are sufficient to hold the wear bar 34 against the screed frame 36.

The second set of frame alignment holes 48 and the second set of wear bar alignment holes 54 may be connected together by any of a variety of ways that may be commonly employed. For example, nuts and bolts, dowel pins, screws, nails, rods or other types of mechanisms may be employed for connecting the second set of frame alignment holes 48 with the second set of wear bar alignment holes 54. After connecting at least one of the second set of frame alignment holes 48 with at least one of the second set of wear bar alignment holes 54 to hold the wear bar 34 against the screed frame 36, the first set of frame alignment holes 46 may be aligned with the first set of wear bar alignment holes 52 at a step 66.

Specifically, depending upon the height tolerance that is desired between the wear bar 34 and the screed plate 38, one of the substantially sloping holes in each hole cluster of the first set of wear bar alignment holes 52 may be aligned with one of the substantially horizontal holes in each hole cluster of the first set of frame alignment holes 46 and connected together by any of a variety of fastening mechanisms such as nuts/bolts, screws, dowel pins, nails, and the like. As discussed above, a higher sloping one of the first set of wear bar alignment holes 52 may align with the first set of frame alignment holes 46 for a thicker screed plate 38, while a lower sloping one of the first set of wear bar alignment holes may align for a thinner screed plate.

Next, at a step 68, the remaining ones (e.g., those not connected at the step 64) of the second set of frame alignment holes 48 may be connected to corresponding second set of wear bar alignment holes 54. Then, all of the holes (the first set of frame alignment holes 46 and the corresponding first set of wear bar alignment holes 52; the second set of frame alignment holes 48 and the corresponding second set of wear bar alignment holes 54) may be tightened to maintain the rigidity of the wear bar/screed frame interface. The process ends at a step 70.

Thus, the present disclosure provides a mechanism to mount the wear bar to the screed frame and maintaining the desired height tolerance while accounting for the varying thicknesses of the screed plate 38 and the length variation due to heating of components. By virtue of providing holes in both the screed frame and the wear bar and aligning those holes to maintain the height tolerance, the present disclosure avoids the need for grinding or drilling the wear bar to achieve the desired height tolerance. This not only reduces the time required to mount and assemble the wear bar to the screed frame, it also avoids the labor costs associated with the grinding of the wear bar and simplifies the mounting and replacement process.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A method for mounting a wear bar to a screed frame of a screed section proximate a bottom edge of the screed frame, the method comprising:

providing a first set of frame alignment holes on the screed frame, the first set of frame alignment holes having a substantially horizontal orientation along a plane parallel to the bottom edge of the screed frame;

providing a first set of wear bar alignment holes on the wear bar, the first set of wear bar alignment holes aligned in a hole cluster having a substantially sloping orientation; and aligning at least one of the first set of frame alignment holes with at least one of the first set of wear bar alignment holes to achieve a desired height tolerance of the wear bar relative to a screed plate, wherein aligning a second at least one of the first set of frame alignment holes with a second at least one of the first set of wear bar alignment holes achieves a second desired height tolerance of the wear bar relative to the screed plate.

2. The method of claim 1, wherein the height tolerance of the wear bar relative to the screed plate is substantially zero millimeters.

3. The method of claim 1, wherein the height tolerance of the wear bar relative to the screed plate is less than one millimeters.

4. The method of claim 1, further comprising a second set of frame alignment holes on the screed frame capable of aligning with a second set of wear bar alignment holes on the wear bar.

5. The method of claim 4, wherein each of the second set of frame alignment holes and the second set of wear bar alignment holes are substantially horizontal in orientation.

6. The method of claim 1, wherein the first set of frame alignment holes comprises a plurality of clusters with each of the clusters having a plurality of holes with the substantially horizontal orientation.

7. The method of claim 1, wherein the first set of wear bar alignment holes comprises a plurality of clusters with each of the clusters having a plurality of holes with the substantially sloping orientation.

8. The method of claim 1, wherein aligning the first set of frame alignment holes with the first set of wear bar alignment holes comprises connecting at least one of a second set of frame alignment holes to at least one of a second set of wear bar alignment holes.

9. A screed assembly, comprising:

a screed section having a screed frame and the screed frame having a plurality of frame alignment holes along a length thereof having a substantial horizontal orientation along a plane parallel to a bottom edge of the screed frame; and a wear bar coupled to the screed frame and having a plurality of wear bar alignment holes along a length thereof and the plurality of wear bar alignment holes substantially corresponding in placement to the plurality of frame alignment holes and being aligned in a hole cluster having a substantially sloping orientation, the plurality of wear bar alignment holes and the plurality of frame alignment holes capable of mounting the wear bar to the screed frame via a fastener, wherein the wear bare achieves a first height tolerance relative to the screed plate when a first at least one of the plurality of wear bar alignment holes is aligned with a first at least one of the plurality of frame alignment holes, and the wear bar achieves a second height tolerance relative to the screed plate when a second at least one of the plurality of wear bar alignment holes is aligned with a second at least one of the plurality of frame alignment holes.

10. The screed assembly of claim 9, wherein the plurality of frame alignment holes comprises a first set of frame alignment holes and a second set of frame alignment holes, each of the first and the second set of frame alignment holes having a substantially horizontal orientation.

11. The screed assembly of claim 10, wherein the plurality of wear bar alignment holes comprises a first set of wear bar alignment holes having a substantially sloping orientation and a second set of wear bar alignment holes having a substantially horizontal orientation.

12. The screed assembly of claim 11, wherein the placement of each of the second set of frame alignment holes corresponds with one of the second set of wear bar alignment holes.

13. The screed assembly of claim 11, wherein the first set of frame alignment holes comprises a plurality of clusters, each of the plurality of clusters having a plurality of holes with the substantially horizontal orientation and the first set of wear bar alignment holes comprises a plurality of clusters, each of the plurality of clusters having a plurality of holes with the substantially sloping orientation.

14. The screed assembly of claim 13, wherein one of the plurality of holes in each of the plurality of clusters of the first set of frame alignment holes aligns with one of the holes in each of the plurality of clusters of the first set of wear bar alignment holes.

15. The screed assembly of claim 13, wherein a higher one of the holes in each of the plurality of clusters of the first set of wear bar alignment holes aligns with one of the holes in each of the plurality of clusters of the first set of frame alignment holes for a thicker screed plate.

16. The screed assembly of claim 13, wherein a lower one of the holes in each of the plurality of clusters of the first set of wear bar alignment holes aligns with one of the holes in each of the plurality of clusters of the first set of frame alignment holes for a thinner screed plate.

17. A paving machine, comprising:

an engine; and a screed assembly operatively associated with the engine, the screed assembly having a plurality of screed sections, each of the screed sections having a screed frame with a first set of frame alignment holes in a substantially horizontal orientation; and a wear bar mounted at least indirectly to the screed frame of each of the plurality of screed sections and having a first set of wear bar alignment holes in a substantially sloping orientation, each of the first set of wear bar alignment holes capable of aligning with one of the first set of frame alignment holes, wherein the wear bare achieves a first height tolerance relative to the screed frame when a first at least one of the first set of wear bar alignment holes is aligned with a first at least one of the first set of frame alignment holes, and the wear bar achieves a second height tolerance relative to the screed plate when a second at least one of the plurality of wear bar alignment holes is aligned with a second at least one of the plurality of frame alignment holes.

18. The paving machine of claim 17, further comprising a tamper bar mounted at least indirectly to each of the wear bars.

19. The paving machine of claim 17, wherein the wear bar is mounted to the screed frame such that a bottom edge of the wear bar is about zero millimeters to about one millimeters above a bottom edge of the screed plate.

20. The paving machine of claim 17, further comprising a second set of frame alignment holes substantially aligning with a second set of wear bar alignment holes.

* * * * *